US009102433B2

(12) United States Patent
Cordioli

(10) Patent No.: US 9,102,433 B2
(45) Date of Patent: Aug. 11, 2015

(54) LABELING MACHINE, PARTICULARLY FOR LABELING CONTAINERS

(75) Inventor: Andrea Cordioli, Roverbella (IT)

(73) Assignee: P.E. Labellers S.P.A., Porto Mantovano (IT)

( * ) Notice: Subject to any disclaimer, the term of this patent is extended or adjusted under 35 U.S.C. 154(b) by 234 days.

(21) Appl. No.: 13/816,699

(22) PCT Filed: Jun. 28, 2011

(86) PCT No.: PCT/EP2011/060845

§ 371 (c)(1),
(2), (4) Date: Feb. 12, 2013

(87) PCT Pub. No.: WO2012/019824

PCT Pub. Date: Feb. 16, 2012

(65) Prior Publication Data

US 2013/0139970 A1 Jun. 6, 2013

(51) Int. Cl.

| | |
|---|---|
| ***B65C 9/40*** | (2006.01) |
| ***B65B 9/04*** | (2006.01) |
| ***B65C 9/00*** | (2006.01) |

(52) U.S. Cl.

CPC ... *B65C 9/40* (2013.01); *B65C 9/00* (2013.01); *B65C 9/0062* (2013.01); *Y10T 156/17* (2015.01)

(58) Field of Classification Search

CPC ..... Y10T 156/17
USPC ..... 156/542, 568, 521, 522
See application file for complete search history.

(56) References Cited

U.S. PATENT DOCUMENTS

| | | | |
|---|---|---|---|
| 2009/0294070 | A1 | 12/2009 | Kellhammer et al. |
| 2013/0139969 | A1 | 6/2013 | Giuliani et al. |

FOREIGN PATENT DOCUMENTS

| | | |
|---|---|---|
| DE | 102005041531 | 3/2007 |
| DE | 19758799 | 3/2008 |
| EP | 1553045 | 7/2005 |
| WO | 2010072653 | 7/2010 |
| WO | 2011154980 | 12/2011 |

OTHER PUBLICATIONS

European Search Report, Nov. 25, 2013.

*Primary Examiner* — Linda L Gray
(74) *Attorney, Agent, or Firm* — Greer, Burns & Crain Ltd.

(57) ABSTRACT

Labeling machine, particularly for labeling containers, comprising a rotating carousel for supporting pans, at least one pair of identical labeling assemblies being provided which are arranged consecutively at the peripheral region of the rotating carousel, each one of the labeling assemblies being associated with a slider slidable on guides between a forward active position, for applying the labels to the containers supported by the rotating carousel, and a retracted position, designed to load a reel of tape provided with the labels, the protective structure, which surrounds the rotating carousel, having, at each labeling assembly, a door movable by the action of elements that connect the door to the slider which supports the labeling assembly between an open position, assumed when the labeling assembly is in the forward position, and a closed position, assumed when the labeling assembly is in the retracted position.

4 Claims, 6 Drawing Sheets

LABELING MACHINE, PARTICULARLY FOR LABELING CONTAINERS

CROSS-REFERENCES TO RELATED APPLICATIONS

This application claims the benefit of the Italian patent application No. MI2010A001554 filed on Aug. 13, 2010, the entire disclosures of which are incorporated herein by way of reference.

TECHNICAL FIELD

The present invention relates to a labeling machine, particularly for labeling containers.

BACKGROUND OF THE INVENTION

Nowadays, labeling machines are known which comprise a rotating carousel for supporting pans adapted for the resting of individual containers to be labeled, and also comprising at least one pair of identical labeling assemblies which are arranged consecutively at the peripheral region of the carousel.

Each labeling assembly is associated with a slider slidable on guides between a forward active position, in which the labels taken from a tape wound on reels are applied to the containers, and a retracted position designed to load the labels on the reel of tape.

During the operation of the machine, the labeling assemblies are in the forward position, and while one of the assemblies is performing the application of labels onto the containers, gradually consuming the associated reel of tape, the other assembly is waiting and is provided with an intact reel.

When the reel of the labeling assembly that has performed the application of labels has run out, the assembly that was waiting automatically comes into operation, so as to ensure the continuity of operation of the machine.

This exchange takes place with the help of an operator who brings the slider for supporting the labeling assembly that has finished its reel of tape into the retracted position, mounts a new reel of tape, and brings the assembly into the forward position again.

In this manner, the situation is restored wherein both of the assemblies are situated in the forward position, ready to perform the alternation of operation described above.

Obviously, the rotating carousel is provided with a protective structure that prevents access to the carousel proper during operation.

Since the forward position of each labeling assembly is such that the front part of the assembly is situated beyond the protective structure, on the carousel side, and since the retracted position of the assembly is such that this same front part is outside the protective structure, it implies that the presence is necessary, for each labeling assembly, of means that are capable of preventing intrusions beyond the protective structure when the labeling assembly is in the retracted position, and which are capable of allowing the assembly to pass through when it needs to be brought to the forward active position.

The means available today are not entirely satisfactory.

SUMMARY OF THE INVENTION

Therefore the aim of the present invention is to provide a labeling machine, particularly for labeling containers, in which the means of protection against interventions with the rotating carousel exhibit the utmost operational efficiency.

This aim, as well as other objects which will become more apparent hereinafter, are achieved by a labeling machine, particularly for labeling containers, comprising a rotating carousel for supporting pans adapted for the resting of the individual containers to be labeled, provided with a protective structure which prevents, during operation, access to said rotating carousel, and further comprising at least one pair of identical labeling assemblies, which are arranged consecutively at the peripheral region of said rotating carousel, each one of said labeling assemblies being associated with a slider slidable on guides between a forward active position, for applying the labels to the containers supported by said rotating carousel, and a retracted position, designed to load a reel of tape provided with the labels, characterized in that said protective structure, which surrounds said rotating carousel, has, at each one of said labeling assemblies, a door movable by action of means that connect said door to said slider, which supports said labeling assembly between an open position, assumed when said labeling assembly is in said forward position, and a closed position, assumed when said labeling assembly is in said retracted position.

BRIEF DESCRIPTION OF THE DRAWINGS

Further characteristics and advantages of the invention will become better apparent from the description of a preferred, but not exclusive, embodiment of a labeling machine, particularly for labeling containers, according to the present invention, illustrated by way of non-limiting example in the accompanying drawings wherein.

DETAILED DESCRIPTION OF THE PREFERRED EMBODIMENTS

Figure 1:
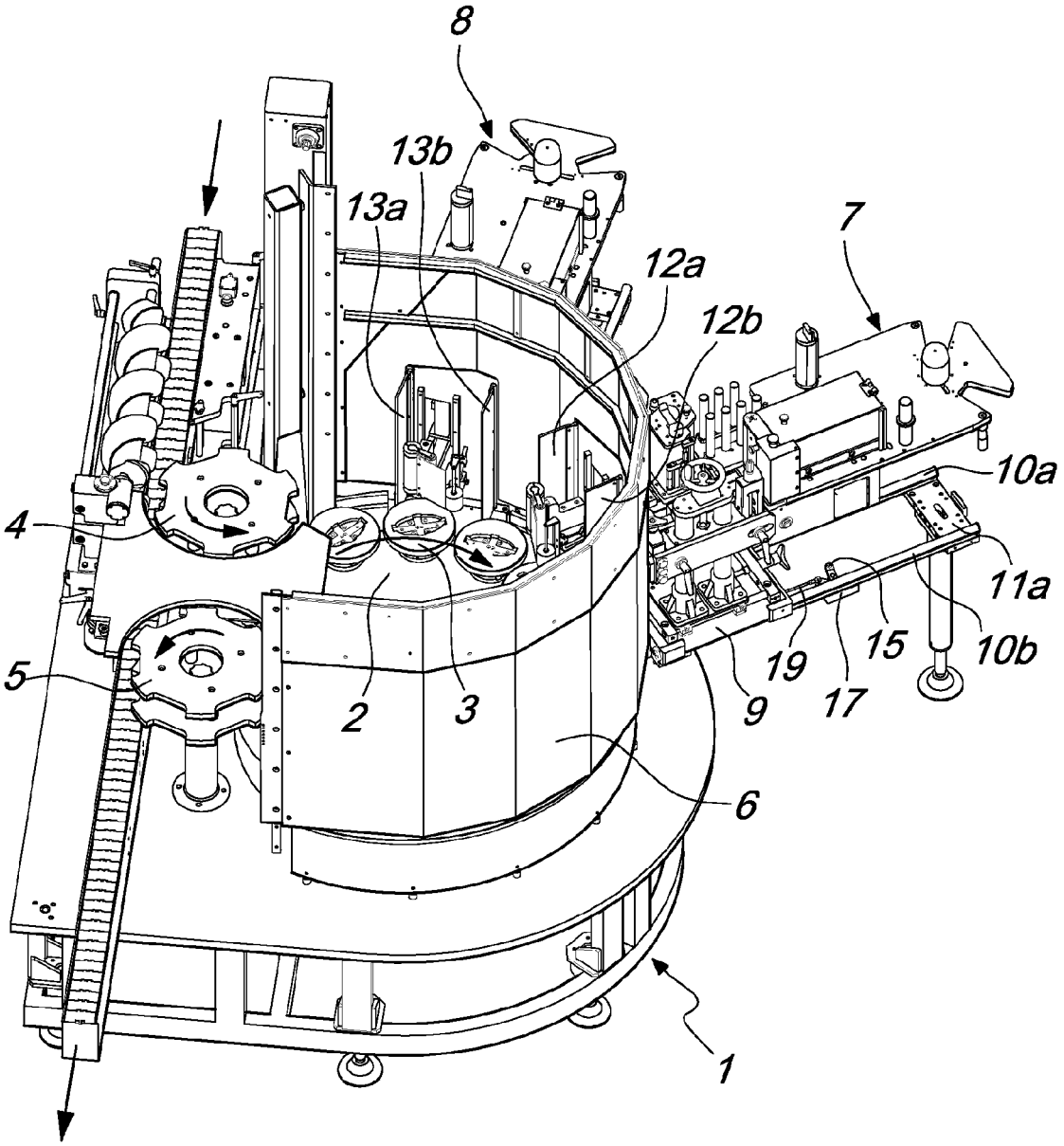
FIG. 1 is a perspective view of an embodiment of a labeling machine, particularly for labeling containers, according to the invention, with two labeling assemblies located in their forward active position.

With reference to the figures, the labeling machine, particularly for labeling containers, generally indicated with the reference numeral 1, comprises a rotating carousel 2 for supporting pans 3 adapted for the resting of individual containers which are fed by way of the entry star wheel 4 and evacuated by way of the exit star wheel 5.

Moreover, a protective structure of the carousel 2 is provided, generally indicated with the reference numeral 6, which prevents, during operation, access to the carousel 2 and two identical labeling assemblies, 7 and 8.

Figure 2:
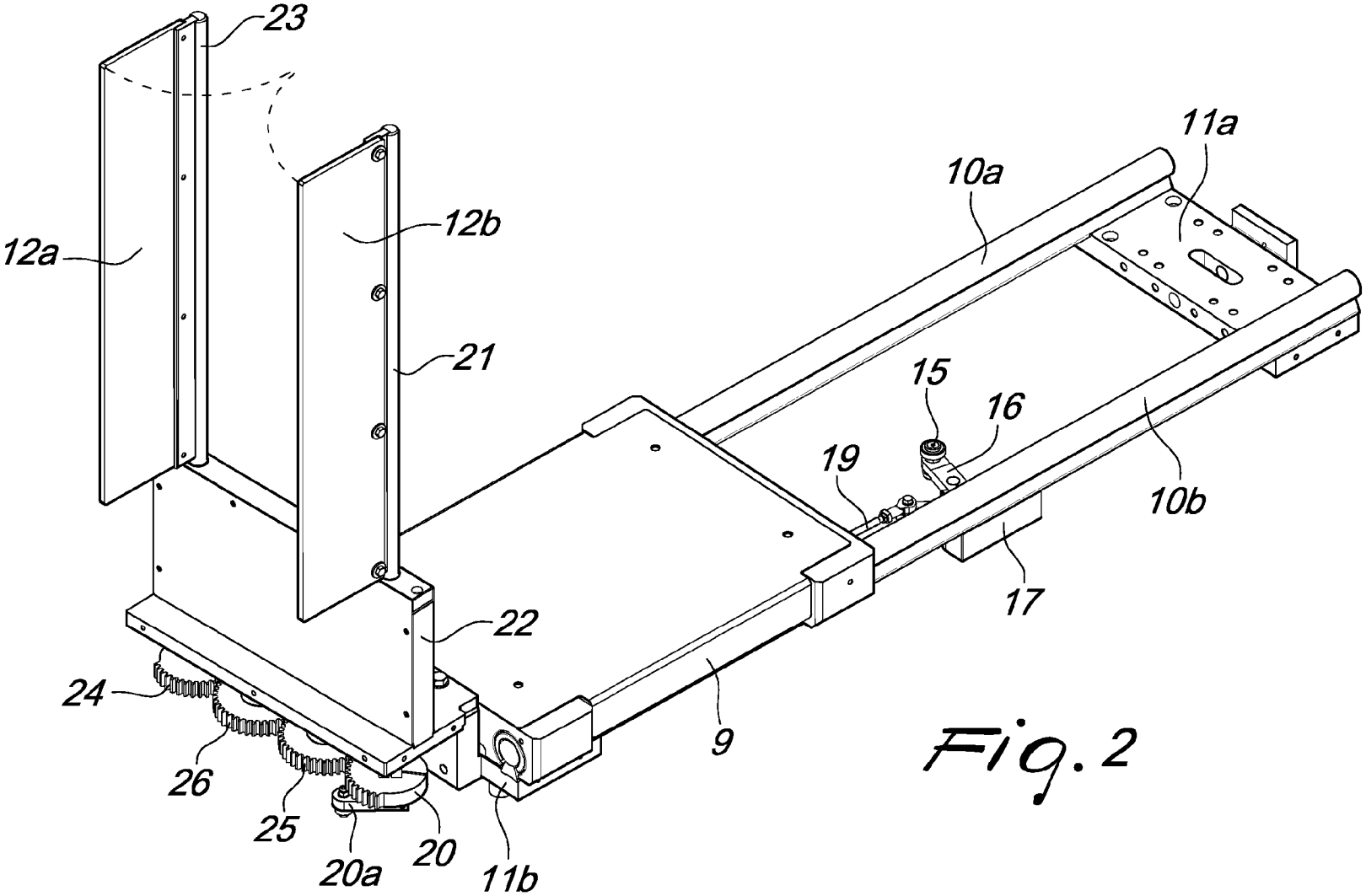
FIG. 2 is a perspective view from above of the slider for supporting a labeling assembly in the forward position, with the associated door, of the machine shown in FIG. 1.
Figure 3:
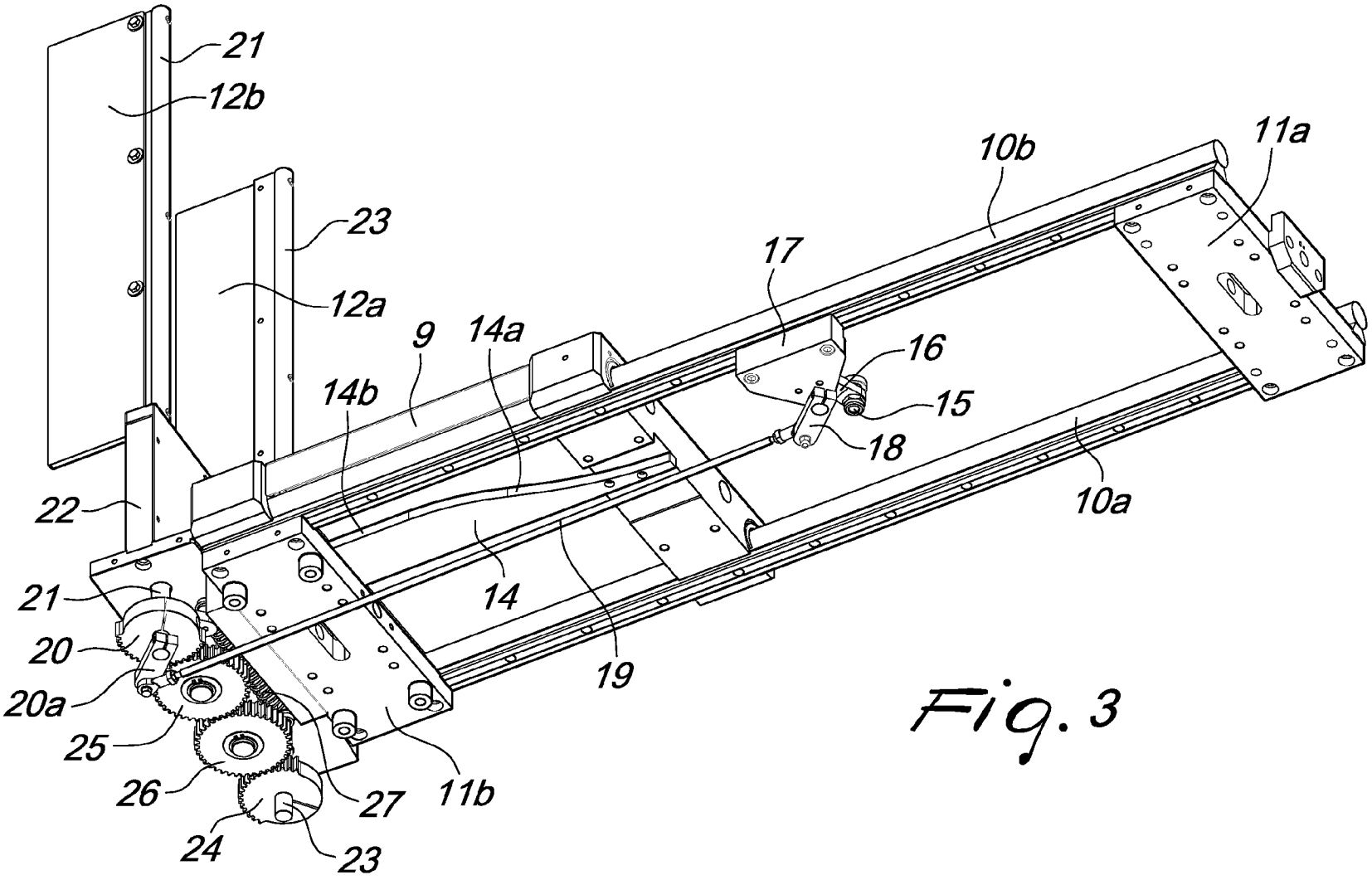
FIG. 3 is a perspective view from below of the supporting slider shown in FIG. 2.
Figure 4:
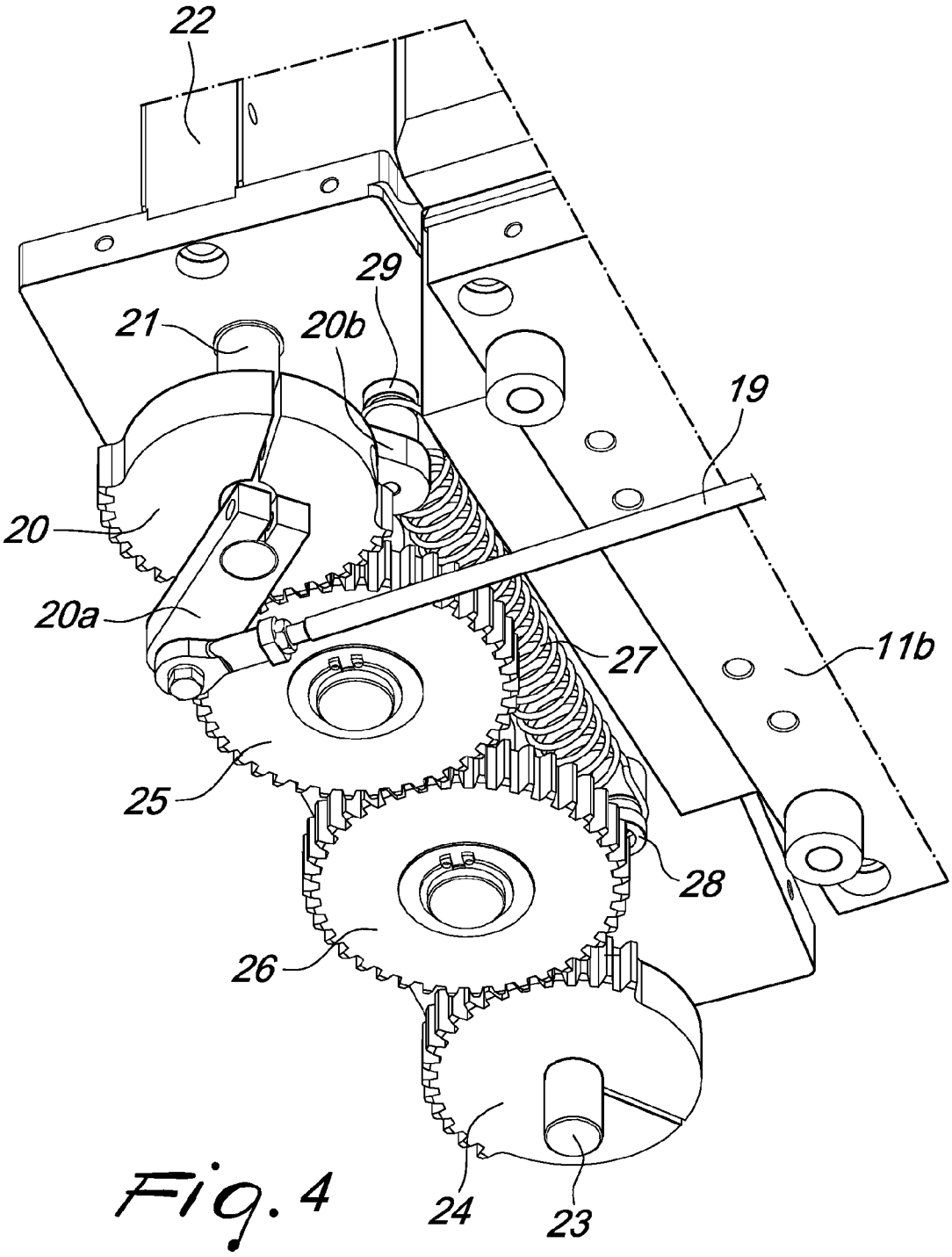
FIGS. 4 and 5 are two enlarged-scale detailed views of two details of the FIG. 6 is a perspective view from above of the detail shown in FIG. 5.
Figure 5:
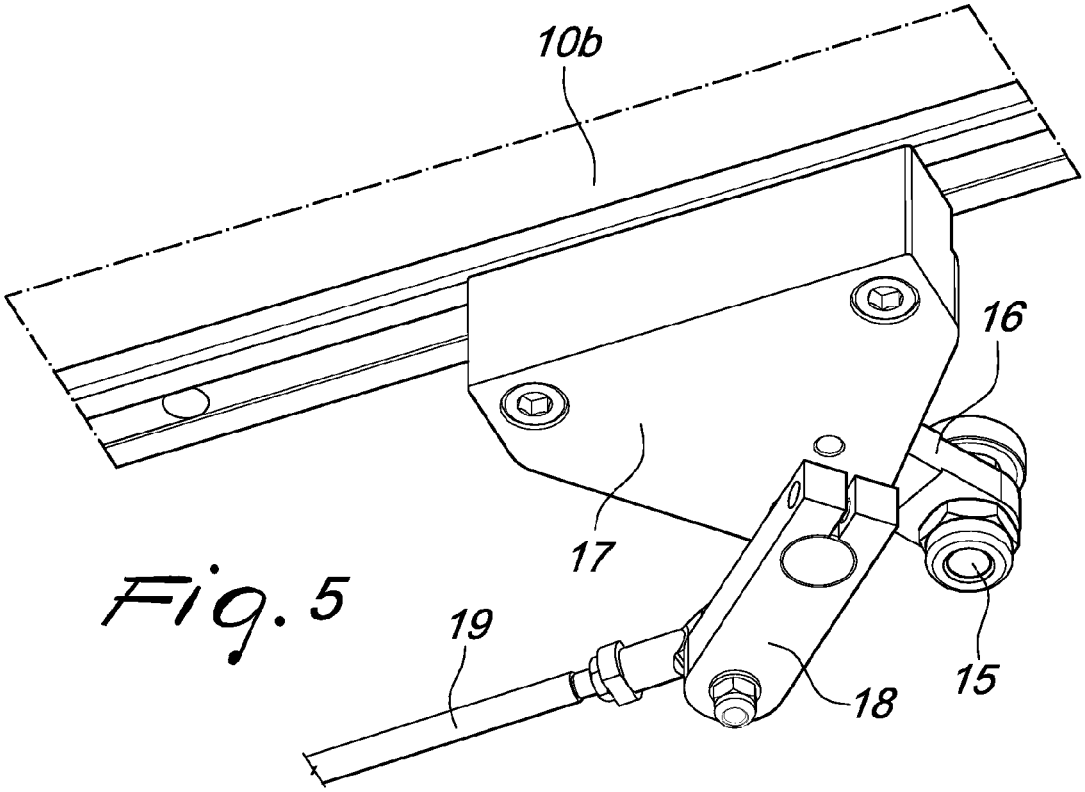
Figure 6:
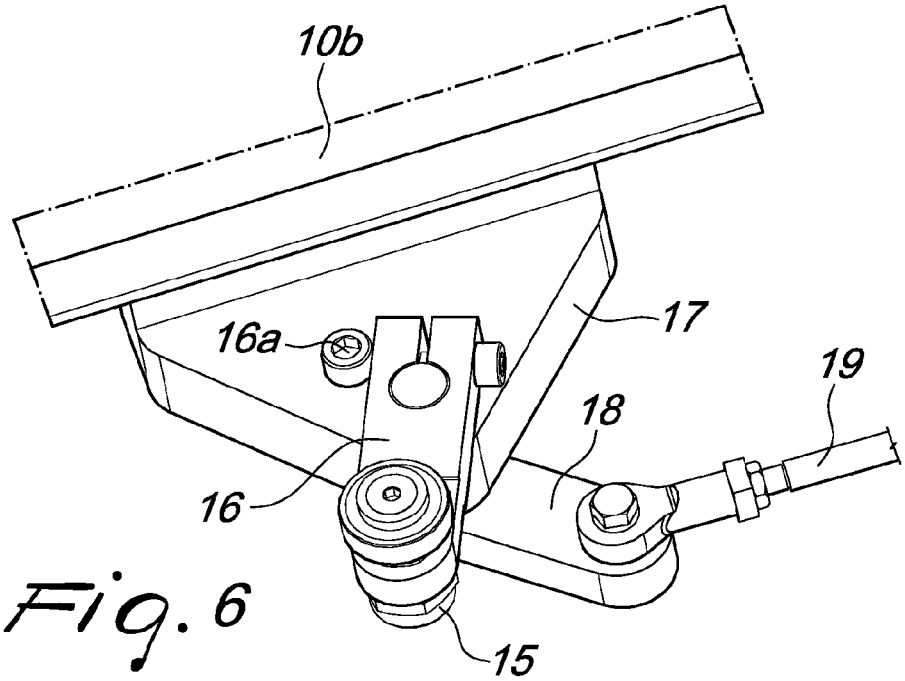
Figure 7:
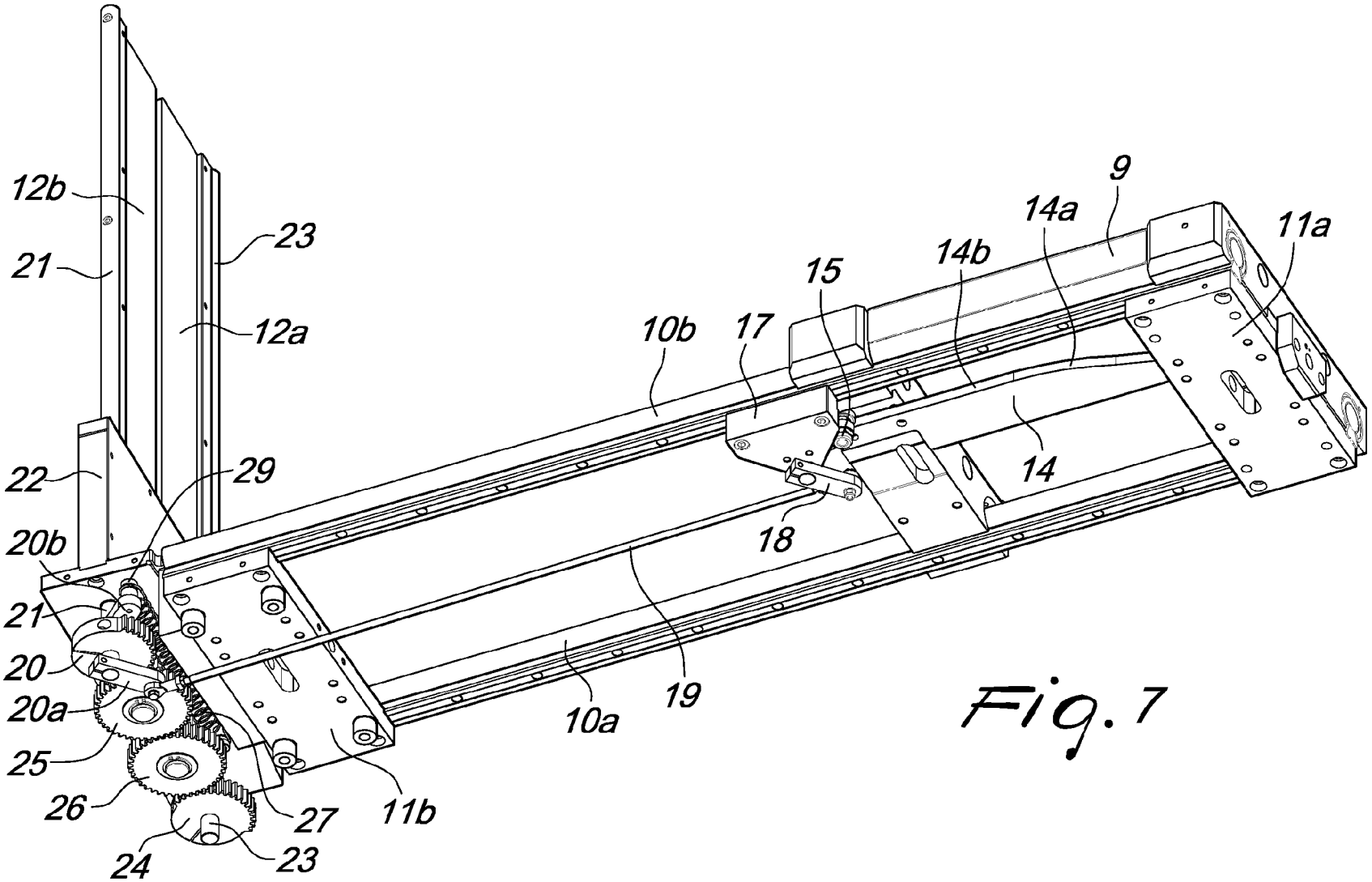
FIG. 7 is a perspective view from below of the slider for supporting a labeling assembly in the retracted position, with the associated door, of the machine shown in FIG. 1.

Each labeling assembly 7 or 8 is associated with a slider 9 slidable on guides 10*a* and 10*b*, mutually connected to crossbars 11*a* and 11*b*, between a forward position, shown in FIGS. 1, 2 and 3, with the associated details shown in FIGS. 4, 5 and 6, in which the labeling assembly 7 is in the active condition for applying the labels to the containers supported by the carousel 2, and the retracted position, shown in FIG. 7, in which the labeling assembly 7 is available for the loading of an intact reel of tape.

At the labeling assembly 7, there is, as part of the protective structure 6, a door formed by wings 12*a* and 12*b* which are movable according to the arrows in FIG. 2 between the open position shown in FIGS. 2 and 3, assumed when the labeling assembly 7 is in the forward position, and the closed position shown in FIG. 7, assumed when the labeling assembly 7 is in the retracted position.

Moreover, a similar door is provided, formed by wings 13*a* and 13*b*, which can be seen in FIG. 1, for the labeling assembly 8.

The movement of the wings 12*a* and 12*b* of the door is performed by means that connect the door with the slider 9.

Such means comprise a cam 14 which is integral with the slider 9 and adapted to actuate a roller 15 associated with an arm 16 which is pivoted, with an end stop 16*a*, on a support 17 fixed to the guide 10*b* and which is connected by way of a linkage 18 with one end of a tension member 19 which at the other end is pivoted on a plate 20*a* integral with a toothed wheel 20 which is keyed to a shaft 21 supporting the wing 12*b*, associated with an element 22 of the structure of the labeling machine 1.

The toothed wheel 20 constitutes the first element of a kinematic chain that connects the shaft 21 supporting the wing 12*b*, on which the toothed wheel 20 is keyed, with a shaft 23 supporting the wing 12*a* associated with the element 22 as well, so as to produce simultaneous and oppositely oriented movements of the wings 12*a* and 12*b* between the open and closed positions.

Such kinematic chain comprises, in addition to the toothed wheel 20, a toothed wheel 24 keyed on the shaft 23, so that the toothed wheels 20 and 24 are connected one another by means of a pair of toothed wheels 25.

Moreover, a spring 27 is provided connected at one end to a fixed pin 28 and at the other end to a pin 29 supported by a plate 20*b* which is integral with the toothed wheel 20, so as to tighten up progressively from the resting situation assumed when the slider 9 is in the forward position shown in FIG. 3 and in the detail of FIG. 4, and the loaded situation assumed when the slider 9 is in the retracted position shown in FIG. 7.

The cam 14 is shaped according to a first inclined section 14*a* that begins at a certain distance from the roller 15 when the slider 9 is in the forward position, and a second section 14*b* which proceeds straight and parallel to the direction of movement of the slider, so as to produce a movement of the roller 15 connected to the cam 14 only at the central section of the stroke of the slider 9.

Operation of the labeling machine 1, according to the present invention, beginning from the situation shown in FIG. 3 with the corresponding details of FIGS. 4, 5 and 6, which shows the slider 9 in the forward position with the labeling assembly 7 in the active position, is described in the following.

In this situation, the wings 12*a* and 12*b* of the door are open, and the labeling assembly is located with the front part beyond the door.

When it is necessary to change the reel of tape of the labeling assembly 7 because it has run out, an operator manually causes the translational movement of the slider 9 from the forward position to the retracted position, and for a first section of the stroke the cam 14 cannot touch the roller 15, so that the wings 12*a* and 12*b* of the door do not move, thus allowing the passage of the labeling assembly 7.

At a certain point the contact of the roller 15 with the cam 14 begins, and more precisely contact with the inclined section 14*a* thereof, and from this moment the roller 15 is moved so as to produce a traction on the tension member 19 which actuates the toothed wheel 20 and all of the kinematic chain deriving from it; in this manner the movement of the wings 12*a* and 12*b* towards the closed position is produced, which position is reached when the roller 15 has finished the path on the inclined section 14*a* of the cam 14.

The motion of the slider 9 then proceeds until the retracted position is reached, with a section of stroke where the roller 15 is in contact with the section 14*b* of the cam which causes no movement of the roller: consequently the wings 12*a* and 12*b* remain motionless in the closed position thus reached, and the labeling assembly 7 moves away from them so as to allow an operator to perform the necessary interventions.

During the described movement of the slider 9, the loading of the spring 27 has been achieved, which, during the return stroke of the slider 9 to the forward position, performs the function of ensuring contact of the roller 15 with the cam 14.

The labeling machine, particularly for labeling containers, thus conceived, is susceptible of numerous modifications and variations, all of which are within the scope of the appended claims.

Moreover, all the details may be replaced by other, technically equivalent elements.

In practice the materials employed, provided they are compatible with the specific use, and the contingent dimensions and shapes, may be any according to requirements and to the state of the art.

The disclosures in Italian Patent Application No. MI2010A001554 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A labeling machine, for labeling containers, comprising a rotating carousel for supporting pans adapted for the resting of individual containers to be labeled, provided with a protective structure which prevents, during operation, access to said rotating carousel, and further comprising at least one pair of identical labeling assemblies, which are arranged consecutively at the peripheral region of said rotating carousel, each one of said labeling assemblies being associated with a slider slidable on guides between a forward active position, for applying labels to the containers supported by said rotating carousel, and a retracted position, designed to load a reel of tape provided with the labels, wherein said protective structure, which surrounds said rotating carousel, has, at each one of said labeling assemblies, a door movable by action of means that connect said door to said slider, which supports said labeling assembly between an open position, assumed when said labeling assembly is in said forward position, and a closed position, assumed when said labeling assembly is in said retracted position.

2. The labeling machine according to claim 1, wherein said slider for supporting said labeling assembly is provided with a cam for actuating a roller which is associated with an arm, which is pivoted on a fixed support and connected by means of a linkage to a tension member for actuating a kinematic chain which connects two shafts, each designed to support a wing of the door inserted in said protective structure so as to produce simultaneous and oppositely oriented movements of said wings between the open and closed positions of said door.

3. The labeling machine according to claim 2, wherein said kinematic chain, which connects said shafts, each designed to support said wings of said door, comprises a first gear, which is connected to said tension member for actuation and is keyed directly onto said shaft of a first wing, and a second gear, which is keyed directly onto said shaft of the second wing and is connected to said first gear by a pair of gears, a spring being provided, fixed at one end and connected at the other end to a tab that protrudes from said first gear, so as to be progressively stretched during the motion of said slider in the direction from the forward position to the retracted position.

4. The labeling machine according to claim 2, wherein said cam integral with the slider for supporting said labeling assembly is shaped so as to move said roller connected thereto only at a central portion of a stroke of said slider.

* * * * *